US008475070B1

(12) United States Patent
Miner et al.

(10) Patent No.: US 8,475,070 B1
(45) Date of Patent: Jul. 2, 2013

(54) HARD SURFACE CLEANING TOOL

(75) Inventors: Jonathan L. Miner, Rockford, MI (US); Sue A. Potter, Grand Rapids, MI (US); Eric J. Hansen, Ada, MI (US); Romaneerat Nemcek, East Grand Rapids, MI (US); Joseph P. Perry, Comstock Park, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 670 days.

(21) Appl. No.: 12/704,188

(22) Filed: Feb. 11, 2010

Related U.S. Application Data

(60) Provisional application No. 61/151,698, filed on Feb. 11, 2009.

(51) Int. Cl.
*A46B 5/02* (2006.01)

(52) U.S. Cl.
USPC ..... 401/190; 401/25; 401/27

(58) Field of Classification Search
USPC ..... 401/16, 25, 27, 137, 138, 139, 190
See application file for complete search history.

(56) References Cited

U.S. PATENT DOCUMENTS

| | | | | |
|---|---|---|---|---|
| 3,008,164 | A | 11/1961 | Herman et al. | |
| D196,707 | S | 10/1963 | Anderson | |
| 3,118,166 | A * | 1/1964 | Bell | 401/25 |
| 3,135,990 | A | 6/1964 | Bergmann et al. | |
| D199,959 | S | 1/1965 | Hulsh | |
| 3,184,781 | A | 5/1965 | Hoxie | |
| 3,223,287 | A | 12/1965 | Sagarin | |
| 3,682,557 | A | 8/1972 | Simon et al. | |
| 3,732,591 | A | 5/1973 | Gach | |
| 4,132,333 | A | 1/1979 | Debard | |
| 4,533,273 | A | 8/1985 | Obata et al. | |
| 4,733,984 | A | 3/1988 | Katsuda et al. | |
| 4,776,716 | A * | 10/1988 | Huang | 401/139 |
| 4,848,946 | A * | 7/1989 | Goncalves | 401/131 |
| D356,259 | S | 3/1995 | Hoyt | |
| D385,789 | S | 11/1997 | Koptis | |
| D386,853 | S | 11/1997 | Koptis | |
| D398,235 | S | 9/1998 | Koptis | |
| D416,388 | S | 11/1999 | Koptis | |
| 6,006,957 | A | 12/1999 | Kunesh | |
| D418,303 | S | 1/2000 | Koptis | |
| 6,065,890 | A * | 5/2000 | Weitz | 401/146 |
| 6,099,184 | A | 8/2000 | Koptis | |
| D433,235 | S | 11/2000 | Koptis | |
| 6,161,736 | A | 12/2000 | Kaufman et al. | |
| 6,315,478 | B1 | 11/2001 | Atkins | |
| 6,799,319 | B2 | 9/2004 | Van Loo | |
| D510,863 | S | 10/2005 | Juhng et al. | |
| 7,470,078 | B2 | 12/2008 | Banco et al. | |

FOREIGN PATENT DOCUMENTS

| | | |
|---|---|---|
| GB | 2023745 A | 1/1980 |
| GB | 2099513 A | 12/1982 |

* cited by examiner

*Primary Examiner* — David Walczak
(74) *Attorney, Agent, or Firm* — McGarry Bair PC

(57) ABSTRACT

A cleaning implement comprises a cleaning body assembly, a trigger assembly, at least one aerosol-cleaning container, a brush assembly, and a squeegee assembly whereby fluid from the cleaning container is dispensed by the trigger assembly. In one embodiment, the squeegee assembly is rotatably mounted to the cleaning body assembly. In another embodiment, the squeegee assembly is removably mounted to the cleaning body assembly.

20 Claims, 7 Drawing Sheets

HARD SURFACE CLEANING TOOL

CROSS-REFERENCE TO RELATED APPLICATION(S)

This application claims the benefit of U.S. Provisional Patent Application No. 61/151,698, filed Feb. 11, 2009, which is incorporated herein by reference in its entirety.

BACKGROUND OF THE INVENTION

1. Field of the Invention

This invention relates to a hard surface cleaning implement that utilizes a replaceable aerosol cleaner container. In one of its aspects, the invention relates to a cleaning implement for removing pet drool from hard surfaces such as windows and sliding doors. In another aspect, the invention can be used in other applications such as cleaning tiles and tubs in the home.

2. Description of the Related Art

U.S. Pat. No. 7,470,078 to Banco et al. discloses a cleaning implement that includes a support head mounting a squeegee blade, a scrubber and optionally a touch-up pad. There is also a collector absorbent pad that is mounted to the support head adjacent the squeegee blade, a sprayer linked to the support head, and a container connectable to the sprayer. The implement can spray cleaning fluid on a window to be cleaned. The scrubber can then be applied, followed by the squeegee. Liquid being removed from the window using the squeegee is then collected in the absorbent pad, which is replaceable when saturated. Any remaining streaks on the surface being cleaned can then be removed by an optional touch-up pad.

U.S. Pat. No. 3,732,591 to Gach discloses an aerosol cap where cleaning material is dispensed when a force is applied to the canister through the cleaning head. A slot in the body removably retains a blade member for wiping dispensed liquid from the surface. A cleat on the body carries the blade member when it is not in use.

U.S. Pat. No. 3,682,557 to Simon et al. discloses a squeegee like cleaning apparatus for removable attachment to an aerosol can. The apparatus has a window structure between the attachment means and the blade such that the dispensed spray can pass there through to permit both spray treatment and squeegee action with a single stroke of the apparatus.

U.S. Pat. No. 3,135,990 to Bergmann et al. discloses a brush and container associated therewith for dispensing fluid during use of the brush. Examples include a scouring brush with a soap solution-dispensing container and a hairbrush with a hair lotion-dispensing container.

U.S. Pat. No. 3,008,164 to Herman et al. discloses snap on attachments for an aerosol can. The attachments can be a brush, polishing cloth, buffing pad, sponge or other suitable polisher, buffer, or applicator. The attachment can have a pair of spring fingers for engaging cans of different sizes.

U.S. Pat. No. 6,315,478 to Atkins discloses a glass-cleaning device including a squeezable bottle having a squeegee wiper edge extending therefrom parallel to the longitudinal axis of the bottle, and a top end being open to enable glass-cleaning fluid to be dispensed therefrom. The top end is movable between a sealed position and a dispensing position. The top end also has an array of bristles for scrubbing glass being cleaned.

GB2099513A to Watkinson discloses a spray-through style aerosol cap with an aperture through which liquid can be sprayed without removing the cap and a hinged flap formed integrally with the cap. The flap has a thimble for engaging the valve button of the aerosol can. The button is operated when the flap is depressed.

GB2023745A to Debard et al. discloses a valve actuator button for an aerosol can mounted in a cap and provided with ramps for automatically orientating the button in the correct angular position with respect to the cap so that the button sprays through an opening in the cap during use.

U.S. Pat. No. 4,132,333 to Debard discloses a method for relative orientation of the spray discharge valve actuator and nozzle of a container with respect to a protective cover, which is designed to operate the valve actuator. The orienting means include two helical ramps and a cooperating lug on the actuator circumferentially aligned with the nozzle.

U.S. Pat. No. 6,161,736 to Kaufman et al. discloses a dispenser apparatus including a can and a discharge valve coupled to the can. A cap includes a chamber having walls that receives a button that is positioned to move the discharge valve. The button is supported in a spaced apart relation from the discharge valve during coupling of the cap to the can to maintain the button in a position disengaged from the discharge valve.

U.S. Pat. No. 6,006,957 to Kunesh discloses an actuator overcap for an aerosol can that permits automated preassembly of button actuators with the overcap via a modified receiving pod. The pod has a means for restricting rotation of the button relative to the pod.

U.S. Pat. No. 6,099,184 to Koptis discloses a dispenser-applicator assembly that mounts to an aerosol can. The cap includes a flexible dispensing tube that conveys liquid from the valve stem of the aerosol can to an applicator surface panel.

U.S. Pat. No. 4,533,273 to Obata et al. discloses an applicator for an aerosol can having a movable nozzle projecting from its head. The applicator includes a cap and a brush attached to the cap. The cap also includes a peripheral wall fittable to the head of the container to surround the nozzle, a nozzle pushing member, and a discharge tube fittable to the nozzle for supplying foam from the can to the brush.

SUMMARY OF THE INVENTION

A cleaning implement according to the invention comprises a cleaning container containing a predetermined amount of cleaning fluid and having a dispenser, a cleaning body that comprises a container receiver configured for selectively receiving an upper end of the cleaning container, a fluid distribution opening adapted to dispense the cleaning fluid from the cleaning container when the cleaning body is mounted to the cleaning container, a trigger assembly adapted to be operably coupled to the dispenser for selectively dispensing the cleaning fluid through the fluid distribution opening and a brush assembly, and a squeegee assembly that is removably mounted to the cleaning body for selective use on the cleaning body.

In one embodiment, the cleaner container comprises a crimped portion, and wherein the container receiver comprises a groove that extends around a lower portion of the cleaning body and receives the crimped portion of the cleaner container.

In yet another embodiment, the container receiver is mounted to the cleaner container by means of the groove and the crimped portion of the cleaner container.

In yet another embodiment, the brush assembly further comprises bristles that are adapted to agitate the cleaning fluid after it has been applied to a surface to be cleaned.

In yet another embodiment, the fluid distribution opening is in the brush assembly. In yet another embodiment, the cleaning container contains an aerosol propellant.

Further according to the invention, a cleaning implement comprises a cleaning container having a predetermined amount of cleaning fluid and having a dispenser. A cleaning body comprises a container receiver configured for selectively receiving an upper end of the cleaning container, a fluid distribution opening adapted to dispense the cleaning fluid from the cleaning container when the cleaning body is mounted to the cleaning container, a trigger assembly configured to be operably coupled to the dispenser for selectively dispensing the cleaning fluid through the fluid distribution opening, a brush assembly, and a squeegee assembly that is rotatably mounted to the container receiver.

In one embodiment, the squeegee is mounted for swiveling. In another embodiment, the cleaning implement comprises at least one aerosol cleaning container containing a predetermined amount of cleaning fluid and having a dispenser and a cleaning body that comprises a container receiver configured for selectively receiving an upper end of the cleaning container, a fluid distribution opening adapted to dispense the cleaning fluid from the cleaning container when the cleaning body is mounted to the cleaning container, a trigger assembly adapted to be operably coupled to the dispenser for selectively dispensing the cleaning fluid through the fluid distribution opening, a brush assembly, and a squeegee assembly.

DESCRIPTION OF THE PREFERRED EMBODIMENT

Figure 1:
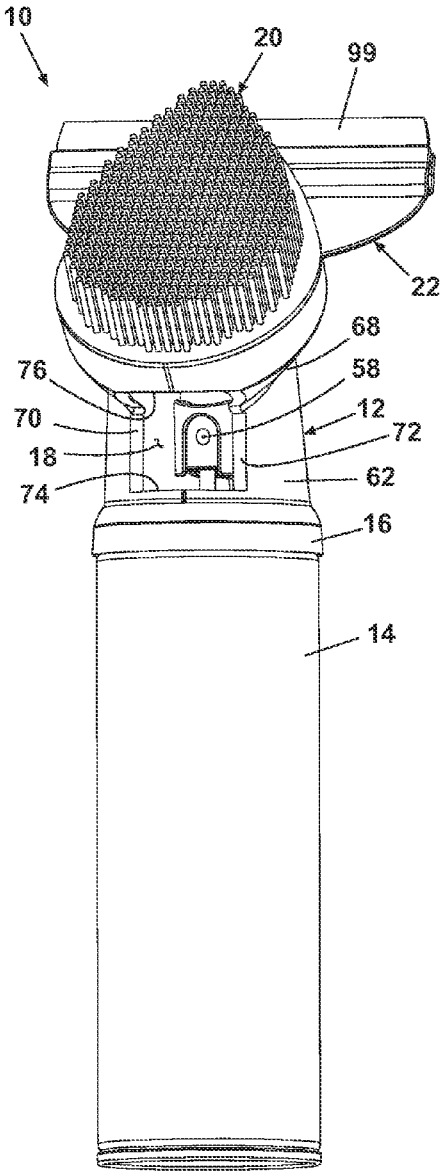
FIG. 1 is a perspective view of an aerosol dispenser assembly according to the invention.
Figure 2:
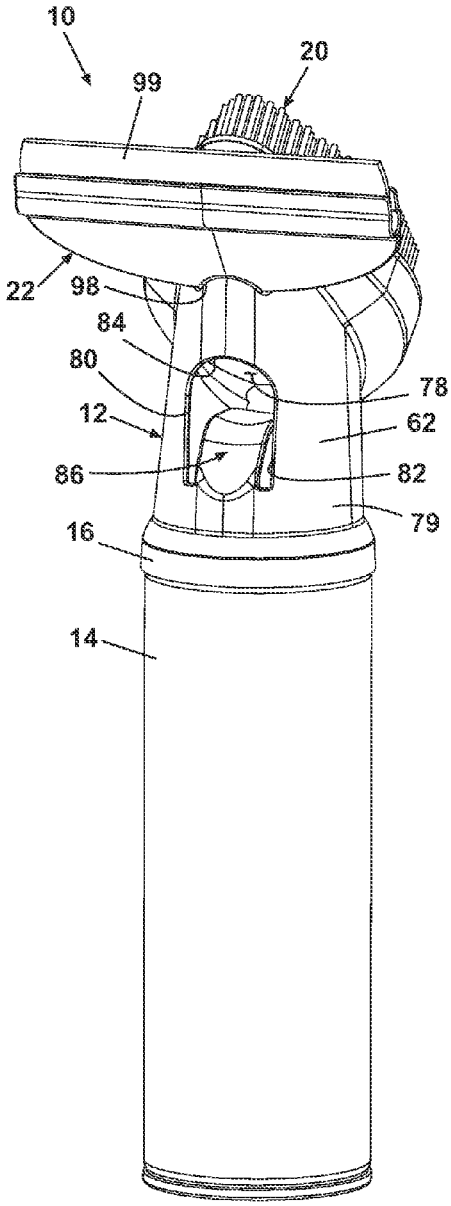
FIG. 2 is a second perspective view of an aerosol dispenser assembly according to the invention.

Referring to the drawings, and in particular to FIGS. 1 and 2, a hard surface cleaning implement 10 comprises a cleaning body assembly 12 and a cleaner container 14 removably attached to the cleaning body assembly 12. The cleaning body assembly 12 further comprises a container receiver 16 that is configured to removably mount to the cleaner container 14, a trigger assembly 86, a fluid distribution opening 18, a brush assembly 20, and a squeegee assembly 22.

Figure 3:
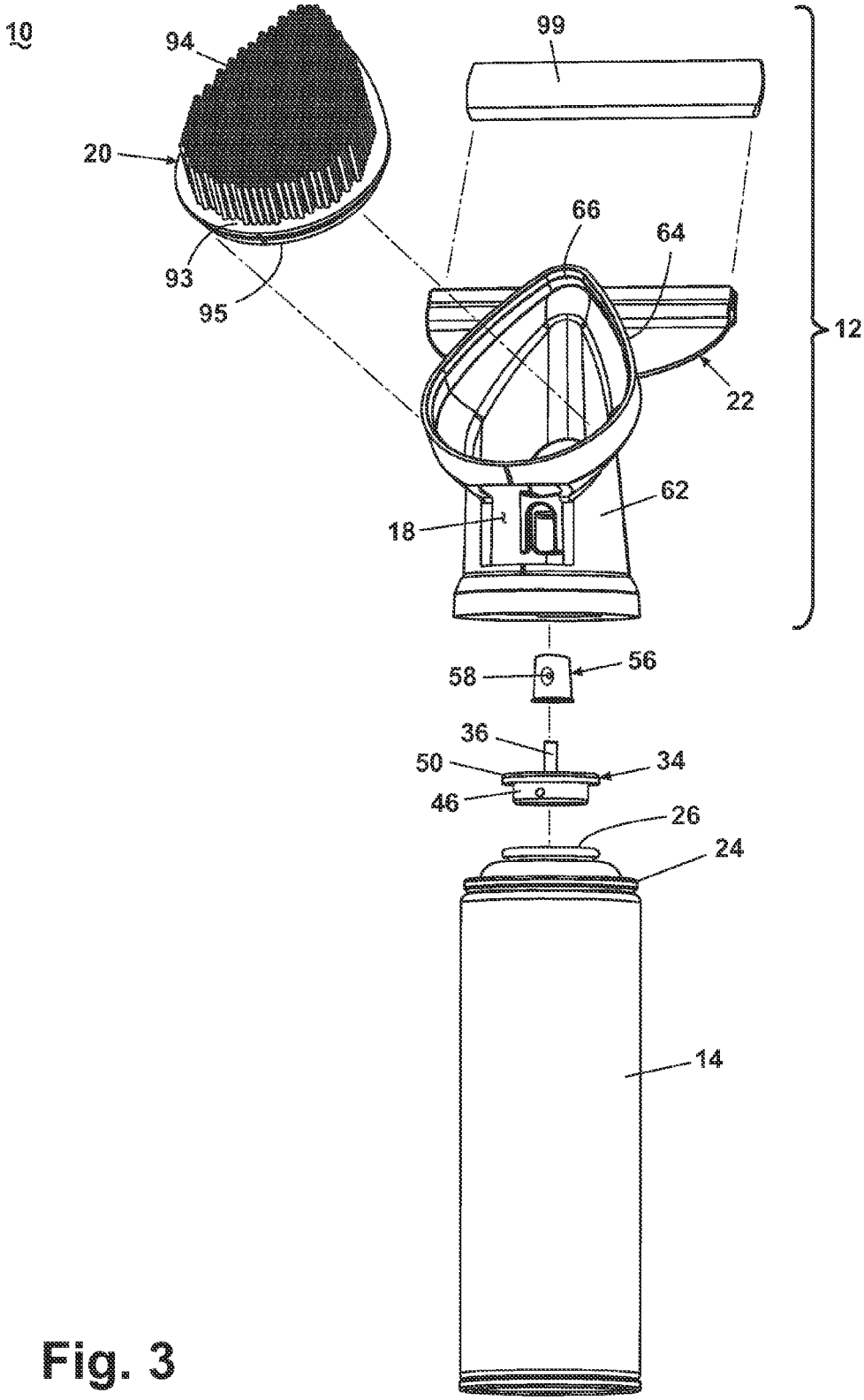
FIG. 3 is an exploded view of the aerosol dispenser assembly as shown in FIG. 1.
Figure 4:
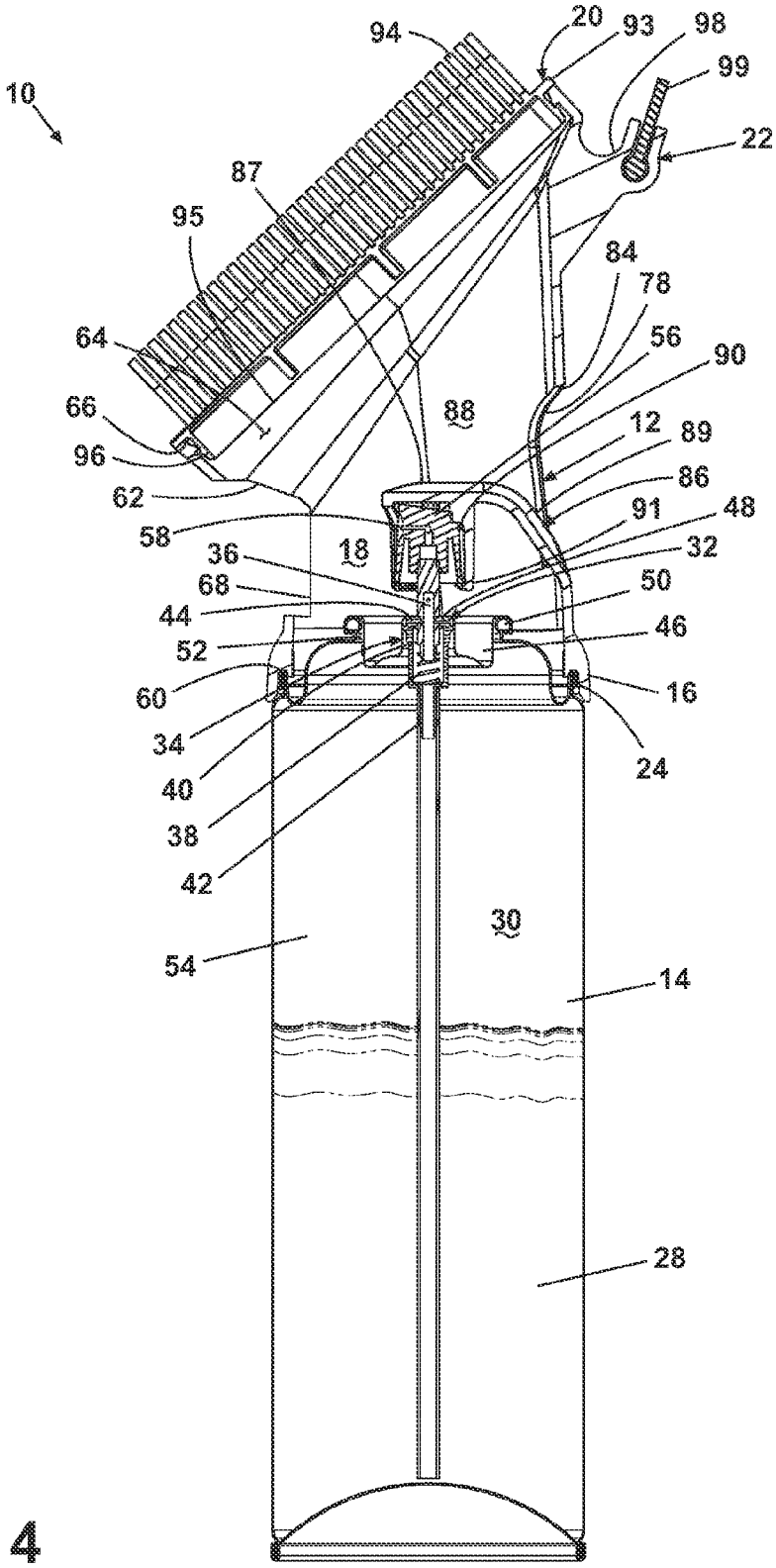
FIG. 4 is a cut-away perspective view of the dispenser assembly shown in FIG. 1.

FIGS. 3 and 4 illustrate the cleaning implement 10 in more detail. The cleaner container 14 is a conventional aerosol dispenser. The cleaner container 14 has a sidewall that is joined at its upper end to a cap 26 through a crimped portion 24 in a conventional fashion. Cap 26 has an open upper end. The cleaner container 14 stores a cleaning fluid 28 in an interior 30 thereof, and is configured to dispense the cleaning fluid through a commonly known valve assembly 32. Thus, the valve assembly 32 will not be described in detail herein except as necessary for a complete understanding of the invention. In the illustrations a valve mounting cup 34 houses the valve assembly 32, which comprises an actuator 36, a spring 38, a plunger 40, a valve stem 42, and a gasket 44.

During manufacture of the cleaner container 14, the valve mounting cup 34 is mounted within the open end of the cap 26 to mount the valve assembly 32 within the cleaner container 14 and to close the open end of cap 26. The valve mounting cup 34 comprises a central cylindrical protrusion 46 having a dispensing opening 48 therein and an annular lip 50 formed on the periphery of the valve mounting cup 34. The annular lip 50 is sized to receive and seal the open end of cap 26 of the cleaner container 14. The annular lip 50 further includes a gasket 52 to seal the cap 26 to the cleaner container 14. The valve mounting cup 34 can be manufactured of coated steel, coated aluminum or any other suitable material. The gasket 52 can be made of a butyl rubber or similar suitable material.

A cleaning fluid 28 of any suitable type that is known in the cleaning fluid art is filled in the interior 30. Preferably an aerosol propellant in for form of a gas or liquid is filled with the cleaning fluid to pressurize the cleaning fluid in the cleaner container 14 in a well know manner. A dispenser formed by a removable button 56 that includes a spray tip orifice 58 is placed on the cleaner container 14 to cover the actuator 36. The actuator 36 is operably coupled to the interior 30 for dispensing the cleaning fluid 28 through the spray tip orifice 58 onto the surface to be cleaned is a conventional manner.

The cleaning body assembly 12 is generally cylindrical and the container receiver 16 is formed by a groove 60 extending completely around its lower end. The container receiver 16 is configured so that the groove 60 can snap fit over the crimped portion 24 of the cleaner container 14. The cleaning body assembly 12 has a peripheral wall 62 that extends upwards from the container receiver 16 and terminates in an open front upper end 64 having retention stops 66. The fluid distribution opening 18 is formed in a front portion 68 of the peripheral wall 62 below the open front upper end 64 and is defined by sidewalls 70 and 72, curved bottom wall 74 and a top wall 76.

A trigger opening 78 is formed in a back portion 79 of the peripheral wall 62 and is defined by curved sidewalls 80 and 82 (FIG. 2) and a top wall 84. The trigger assembly 86 is positioned at the bottom of the trigger opening 78. The trigger assembly 86 has a resilient tongue 89 that is positioned in the opening 78, extends into the inside portion 88 and is connected to a cap 87 that is mounted to the button 56. The trigger cap 87 has a downwardly open slot 90 with retaining tab 91 that receives and retains the button 56. When the button 56 is retained within the slot 90, it is aligned with the fluid distribution opening 18.

The brush assembly 20 includes a brush body 93 and bristles 94 integrally molded to the brush body 93. Alternatively, bristles can be attached to the brush body 93 by traditional staple set tufting or other suitable means. A lower portion 95 of the brush body 93 extends below the bristles 94 and is formed whereby locking portions 96 snap fit into the open front upper end 64 of the cleaning body assembly 12 and are retained by the retention stops 66 located in the open front upper end 64. The squeegee assembly 22 is mounted to the back upper end portion 98 of the cleaning body assembly 12. The squeegee assembly 22 includes a squeegee blade 99.

Referring to FIG. 4, in order to assemble the cleaning body assembly 12 onto the cleaner container 14, a user preferably places the button 56 into the slot 90 of the trigger assembly 86 to position the spray tip orifice 58 so that the cleaning fluid 28 will be dispensed through the fluid distribution opening 18.

Then the cleaning body assembly 12 with the button 56 in place can be inserted onto the cleaner container 14 and the button 56 can be placed onto the actuator 36. In doing so, the groove 60 is fitted to the crimped portion 24 and the cleaning body assembly 12 retains the cleaner container 14.

Hard household surfaces such as windows and sliding doors are often subject to contact with pets living in the household. Often such pets will contact these surfaces with their noses, tongues, or paws. This contact can soil the surface with nose prints, drool deposits, dirty paw prints, or other difficult to remove stains. In use, the cleaning fluid 28 can be dispensed onto such a target surface to be cleaned. The user grips the cleaner container 14 and depresses the cap 87, which in turn dispenses the cleaning fluid 28 in the aerosol spray cleaner container 14 through the valve assembly 32 by depressing the actuator 36 and subsequently creating a fluid flow path between the interior of the cleaner container 14 and the spray tip orifice 58. Depression of the actuator 36 forces the plunger 40 downward, compressing the spring 38, and breaking the seal between the plunger 40 and the gasket 44 to create a space between the gasket 44 and the plunger 40, thereby allowing fluid to flow from the interior 30, up the valve stem, and through the actuator 36 to the spray tip orifice 58. The compressed propellant gas 54 induces a positive pressure inside the interior 30 and forces the cleaning fluid 28 out of the interior 30 and through the spray tip orifice 58. When downward pressure on the cap 87 the actuator 36 is released, the spring 38 forces the plunger 40 and valve stem 42 upward. The plunger 40 seals against the internal gasket 44, the fluid flow path passageway closes and the cleaning fluid 28 ceases to spray out. A user can hold the cleaning implement 10 in various orientations during use, such as upright, inverted, sideways, etc., and still achieve the same dispensing action.

Without turning the cleaning implement 10, a user can then scrub the brush assembly 20 against the target surface to help remove the difficult to remove stains on the target surface. The cleaning implement can then be turned in the user's hand whereby the squeegee assembly 22 can be applied to the target surface. The squeegee assembly 22 can be pulled over the surface whereby excess liquid is removed from the surface. This will allow for faster dry time and less streakage. Further, the user can remove the dirty cleaning fluid without retrieving an additional item such as a towel.

Figure 5:
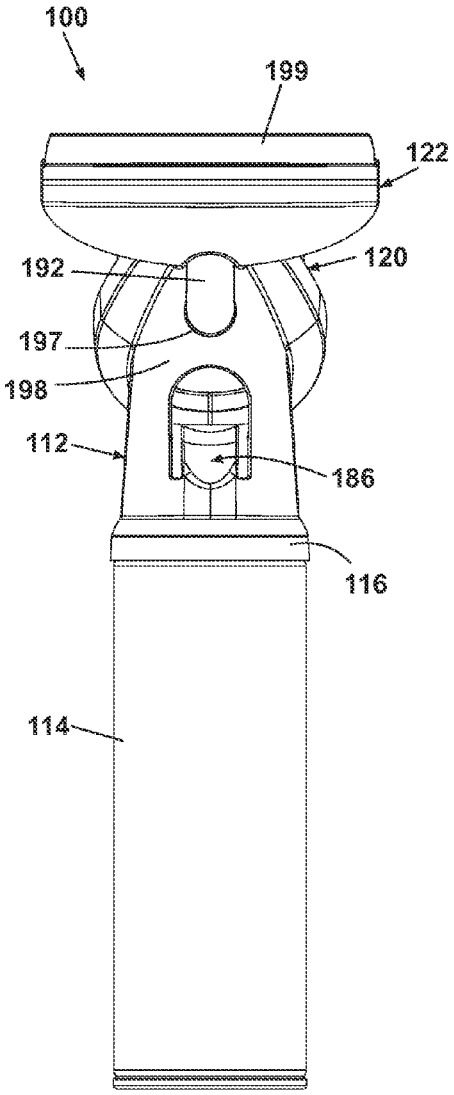
FIG. 5 is a perspective view of an aerosol dispenser assembly according to a second embodiment of the invention.
Figure 6:
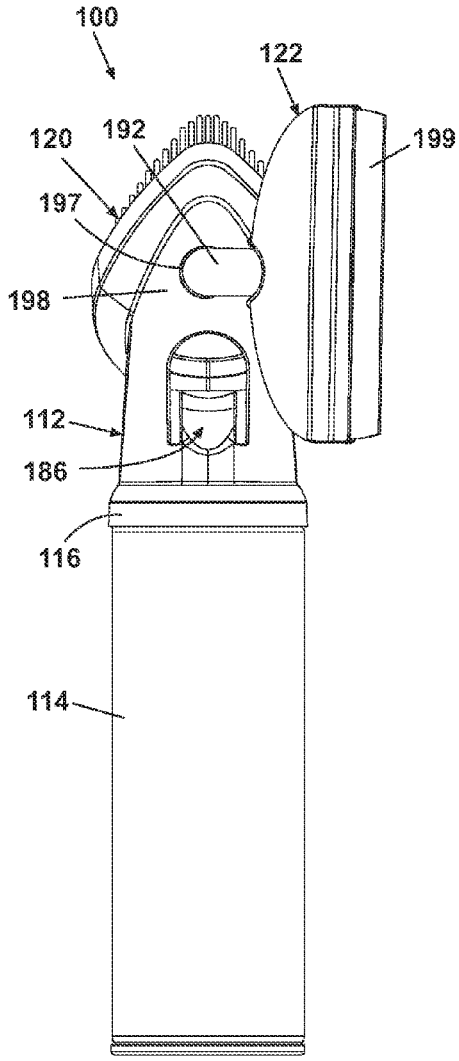
FIG. 6 is a second perspective view of an aerosol dispenser assembly according to a second embodiment of the invention.

FIGS. 5 and 6 are perspective views of a cleaning implement 100, cleaning body assembly 112, brush assembly 120, and squeegee assembly 122 according to a second embodiment of the invention. The second embodiment 100 is similar to the first embodiment 10. Therefore, like parts will be identified with like numerals increased by 100, with it being understood that the description of the like parts of the first embodiment applies to the second embodiment, unless otherwise noted.

One difference between the first embodiment 10 and the second embodiment 100 is that the squeegee assembly 122 is rotatably mounted to the cleaning body assembly 112 by a rotator arm 192. The rotator arm 192 is operably coupled to a complementary projection 197 located on the back upper end portion 198 of the cleaning body assembly 112. The squeegee assembly 122 can be rotated between a first position, or use position, as shown in FIG. 5, and a second position, or storage position, as shown in FIG. 6. A user can use the squeegee to remove fluids from a hard surface when it is in either the first or the second position. When the squeegee assembly 122 is moved to the second position, the cleaning implement 100 has a lower profile where its overall height and width can be reduced. This is particularly beneficial when packing, shipping, and storing multiple cleaning implements 100, because the packing density of the cleaning implements 100 can be maximized, thereby reducing the shipping volume and overall energy costs associated with bulk shipping to a store. Further, the cleaning implements 100 on the store shelves or in the user's cabinet take up less space.

Figure 7:
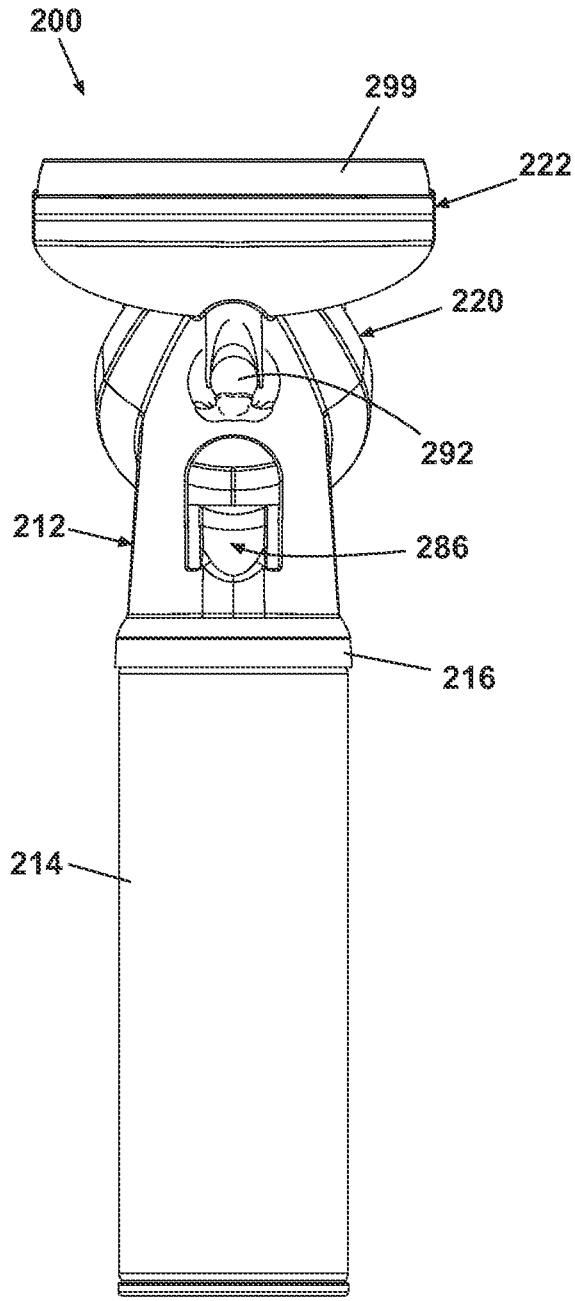
FIG. 7 is a perspective view of an aerosol dispenser assembly according to a third embodiment of the invention.

FIG. 7 is a perspective view of a cleaning implement 200, cleaning body assembly 212, brush assembly 220, and squeegee assembly 222 according to a third embodiment of the invention. The third embodiment 200 is similar to the second embodiment 100. Therefore, like parts will be identified with like numerals increased by 100, with it being understood that the description of the like parts of the second embodiment applies to the third embodiment, unless otherwise noted.

Figure 8:
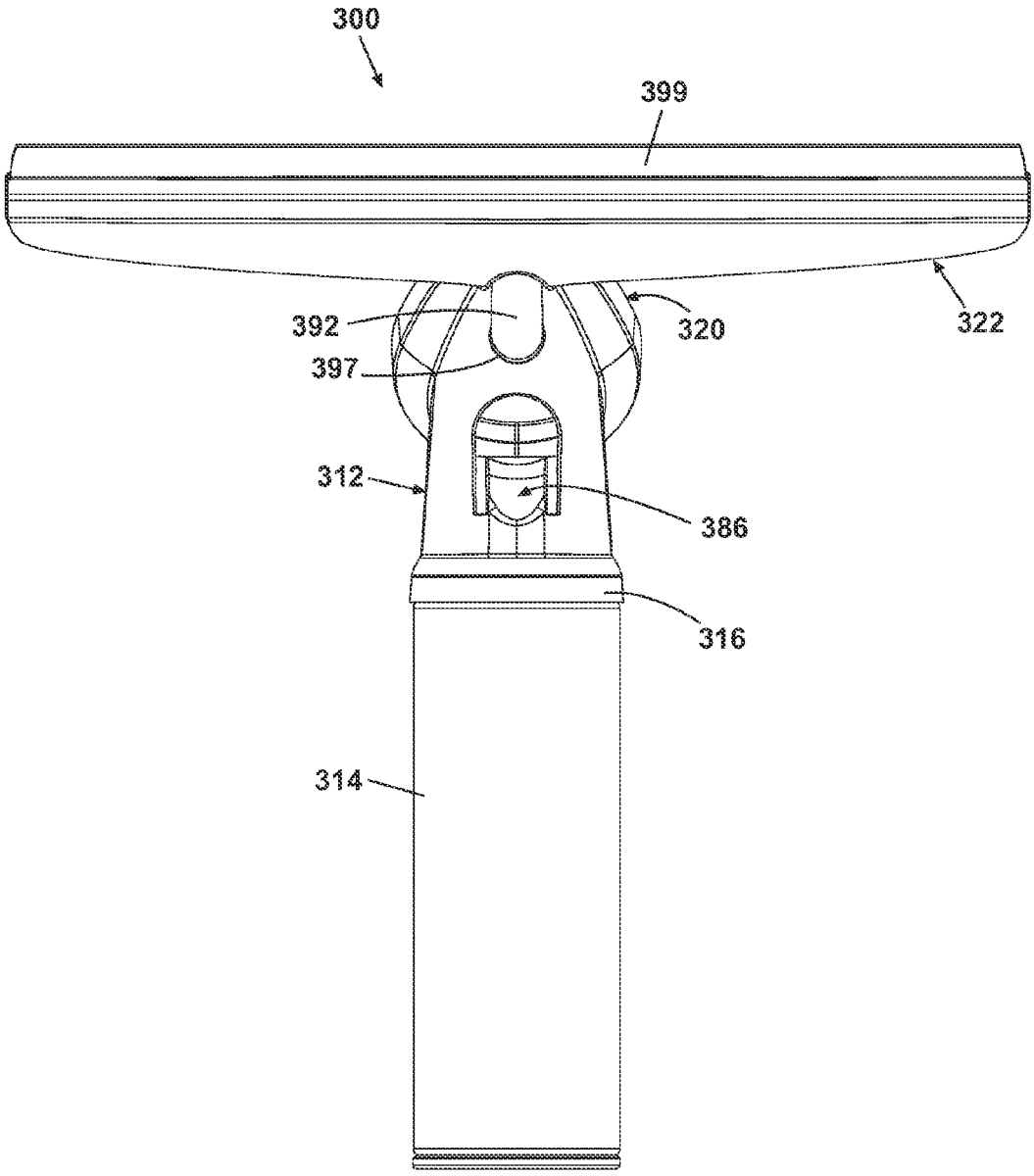
FIG. 8 is a perspective view of an aerosol dispenser assembly according to a fourth embodiment of the invention.
Figure 9:
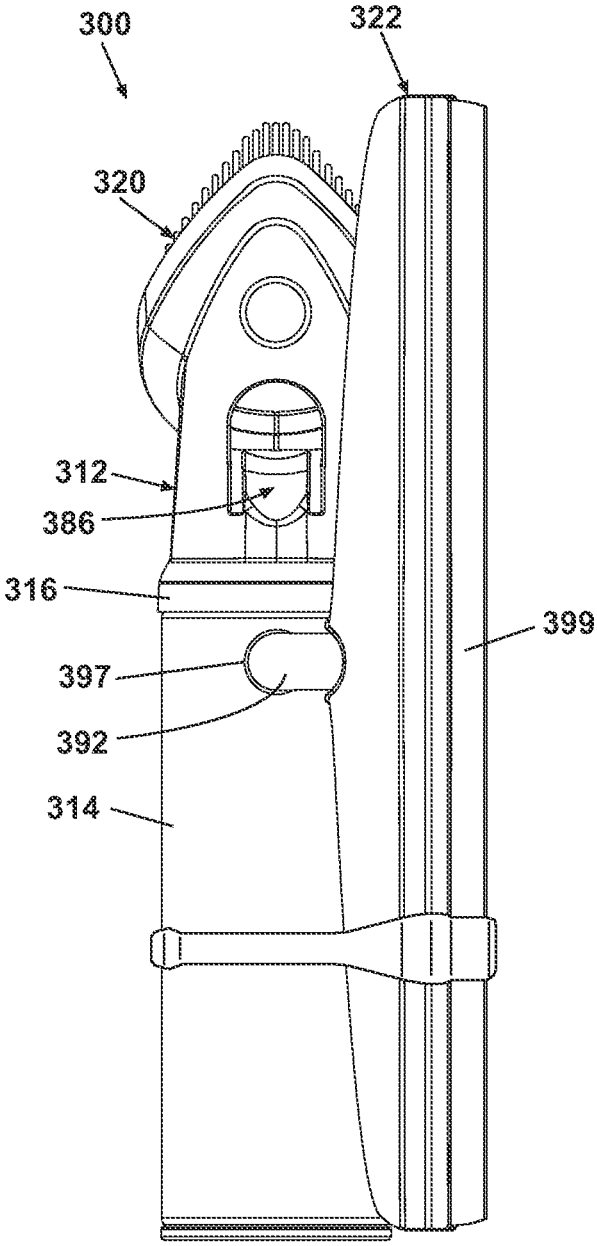
FIG. 9 is a second perspective view of an aerosol dispenser assembly according to a fourth embodiment of the invention.

One difference between the second embodiment 100 and the third embodiment 200 is that the squeegee assembly 222 is rotatably mounted to the cleaning body assembly 212 by a pivot ball rotator arm 292 instead of an axial rotator arm. The pivot ball rotator arm 292 mounts the squeegee assembly 222 to swivel while the user is cleaning for cleaning at a multitude of angles. Further, the squeegee can also be moved to a storage position (not shown) wherein it has a lower profile and is more easily shipped and stocked on store shelves and takes up less room in the user's cabinets FIGS. 8 and 9 are a perspective views of a cleaning implement 300, cleaning body assembly 312, brush assembly 320, and squeegee assembly 322 according to a fourth embodiment of the invention. The fourth embodiment 300 is similar to the second embodiment 100. Therefore, like parts will be identified with like numerals increased by 200, with it being understood that the description of the like parts of the first embodiment applies to the second embodiment, unless otherwise noted.

One difference between the second embodiment 100 and the fourth embodiment 300 is that the squeegee assembly 322 is much longer in the fourth embodiment. This difference removes fluid from more of the surface at one time and creates less work for the user. Further, the squeegee assembly 322 is removably mounted to the cleaning body assembly 312. The squeegee assembly 322 can be mounted in a first position, or use position, as shown in FIG. 8, and can be removed and place in a second position, or storage position, as shown in FIG. 9. In the second position, the squeegee assembly can be taped or banded to the side of the cleaner container 314 and then attached to the cleaning body assembly 312 by the consumer.

While the invention has been specifically described in connection with certain specific embodiments thereof, it is to be understood that this description is by way of illustration and not of limitation. Reasonable variation and modification are possible within the foregoing disclosure and drawings without departing from the scope of the invention which is defined in the appended claims. For example, the cleaning implement with the brush and squeegee can be adapted for use on tubs and tile by changing the cleaning fluid dispensed.

What is claimed is:

1. A cleaning implement, comprising:

a cleaner container containing a predetermined amount of cleaning fluid and having a dispenser formed by a button;

a cleaning body comprising;

a container receiver sized for selectively mounting to an upper end of the cleaner container;

a fluid distribution opening adapted to dispense the cleaning fluid from the cleaner container when the cleaning body is mounted to the cleaner container;

a trigger assembly having a resilient tongue and operably coupled to the button forming the dispenser for selectively dispensing the cleaning fluid through the fluid distribution opening said tongue having a free end operably coupled to said button; and a brush assembly; and a squeegee assembly that is removably mounted to the cleaning body for selective use on the cleaning body.

2. The cleaning implement of claim 1, wherein the cleaner container further comprises a crimped portion, and wherein the container receiver comprises a groove that extends around a lower portion of the cleaning body and receives the crimped portion of the cleaner container.

3. The cleaning implement of claim 2, wherein the container receiver is mounted to the cleaner container by means of the groove and the crimped portion of the cleaner container.

4. The cleaning implement of claim 1, wherein the brush assembly further comprises bristles that is adapted to agitate the cleaning fluid after it has been applied to a surface to be cleaned.

5. The cleaning implement of claim 1, wherein the cleaner container contains an aerosol propellant.

6. A cleaning implement comprising:

at least one cleaner container containing a predetermined amount of cleaning fluid and having a dispenser formed by a button; and a cleaning body comprising;

a container receiver configured for selectively mounting to an upper end of the cleaner container;

a fluid distribution opening in fluid communication with the container dispenser and adapted to dispense the cleaning fluid from the cleaner container when the cleaning body is mounted to the cleaner container;

a trigger assembly having a resilient tongue and configured to be operably coupled to the button forming the dispenser for selectively dispensing the cleaning fluid through the fluid distribution opening said tongue having a free end operably coupled to said button;

a brush assembly; and a squeegee assembly that is rotatably mounted to the container receiver.

7. The cleaning implement from claim 6, wherein the cleaner container further comprises a crimped portion, and wherein the container receiver comprises a groove that extends around a lower portion of the cleaning body and receives the crimped portion of the cleaner container.

8. The cleaning implement from claim 7, wherein the container receiver is mounted to the cleaner container by means of the groove and the crimped portion of the cleaner container.

9. The cleaning implement from claim 6, wherein the brush assembly further comprises bristles that are adapted to agitate the cleaning fluid after it has been applied to a surface to be cleaned.

10. The cleaning implement from claim 6, wherein the at least one cleaner container is an aerosol container that dispenses fluid under pressure.

11. The cleaning implement from claim 6, wherein the squeegee is also mounted to the container receiver for swivel movement.

12. A cleaning implement, comprising:

an aerosol cleaner container containing a predetermined amount of cleaning fluid and having a dispenser formed by a button; and a cleaning body comprising;

a container receiver configured for receiving an upper end of the cleaner container;

a fluid distribution opening adapted to dispense the cleaning fluid from the cleaner container when the cleaning body is mounted to the cleaner container;

a trigger assembly having a resilient tongue and adapted to be operably coupled to the button forming the dispenser for selectively dispensing the cleaning fluid through the fluid distribution opening said tongue having a free end operably coupled to said button;

a brush assembly; and a squeegee assembly.

13. The cleaning implement from claim 12, wherein the container receiver comprises a groove that extends completely around a lower portion of the cleaning body and wherein the cleaner container further comprises a crimped portion.

14. The cleaning implement from claim 13, the container receiver is mounted to the cleaner container by means of the groove and the crimped portion of the cleaner container.

15. The cleaning implement from claim 12, wherein the brush assembly further comprises bristles that are adapted to agitate the cleaning fluid after it has been applied to a surface to be cleaned.

16. The cleaning implement of claim 6 wherein the squeegee assembly is rotatably mounted to the container receiver by a pivot ball rotator arm.

17. The cleaning implement of claim 1, further comprising a trigger opening formed in a portion of the cleaning body.

18. The cleaning implement of claim 17 wherein the resilient tongue is positioned in the trigger opening.

19. The cleaning implement of claim 1 wherein the resilient tongue is operably coupled to a trigger cap having a downwardly open slot that receives the button of the dispenser.

20. The cleaning implement of claim 19 wherein the trigger cap further comprises a retaining tab that retains the button in the downwardly open slot.

* * * * *